US011292031B2

(12) United States Patent
Mayer et al.

(10) Patent No.: US 11,292,031 B2
(45) Date of Patent: Apr. 5, 2022

(54) INLET DOOR SCALPING SCREEN

(71) Applicant: M-I L.L.C., Houston, TX (US)

(72) Inventors: Marc Mayer, Burlington, KY (US); Christopher Meranda, Union, KY (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 120 days.

(21) Appl. No.: 16/719,791

(22) Filed: Dec. 18, 2019

(65) Prior Publication Data

US 2021/0187551 A1 Jun. 24, 2021

(51) Int. Cl.
*B07B 1/36* (2006.01)

(52) U.S. Cl.
CPC ..... *B07B 1/36* (2013.01); *B07B 2201/04* (2013.01)

(58) Field of Classification Search
CPC ..... B07B 1/36; B07B 2201/04
USPC ..... 209/243
See application file for complete search history.

(56) References Cited

U.S. PATENT DOCUMENTS

| | | | | |
|---|---|---|---|---|
| 3,688,902 | A * | 9/1972 | Hubach | B07B 13/04 209/240 |
| 4,322,288 | A * | 3/1982 | Schmidt | B02B 1/02 209/240 |
| 5,271,504 | A * | 12/1993 | Bowen | B07B 1/46 209/316 |
| 8,636,150 | B1 * | 1/2014 | Akers, Jr. | B07B 1/282 209/314 |
| 2012/0018548 | A1 * | 1/2012 | Andela | B03B 9/062 241/24.19 |
| 2013/0220945 | A1 * | 8/2013 | Carr | E21B 21/01 210/768 |
| 2014/0166592 | A1 * | 6/2014 | Holton | B07B 1/40 210/780 |
| 2016/0356108 | A1 * | 12/2016 | Kutryk | B07B 1/46 |
| 2019/0047022 | A1 * | 2/2019 | Meranda | B07B 1/28 |
| 2019/0054502 | A1 * | 2/2019 | Mayer | B07B 13/16 |
| 2021/0187551 | A1 * | 6/2021 | Mayer | B07B 1/36 |

* cited by examiner

*Primary Examiner* — Terrell H Matthews
(74) *Attorney, Agent, or Firm* — Jeffrey D. Frantz

(57) ABSTRACT

A housing inlet for a sifter includes a scalping screen sloped downward in a first direction. The housing inlet also includes a pan positioned at least partially below the scalping screen. The pan is sloped downward in a second direction that is different than the first direction.

16 Claims, 11 Drawing Sheets

INLET DOOR SCALPING SCREEN

BACKGROUND

Gyratory equipment, including gyratory sifters, may be used as a mechanical screen or sieve. Gyratory equipment can be adapted to screen both wet and dry materials. Gyratory sifters may be employed in the hydraulic fracturing, oil, construction, mining, food, chemical, pharmaceutical, and plastics industries among others.

Gyratory equipment may include one or more sets of screens. The screens may be arranged vertically, one on top of the other. The screens may be removable and interchangeable, such that different sets of screens may be used for different applications, and worn or damaged screens may be replaced. Generally, the screens may contain different mesh sizes, where the coarsest (e.g., largest mesh size) screen is nearest to the input, and the finest (e.g., smallest mesh size) is nearest to the final output. A gyratory sifter may have several outputs depending on the application (e.g., one output for each screen), such that the materials unable to pass through each screen may be separately outputted and thus sorted.

An input or feed mechanism may be located at or near the top of a gyratory sifter, (e.g., above or adjacent to the topmost and coarsest screen). When input material is introduced into the gyratory sifter, gyratory motion and gravity enable particles smaller than the mesh size of the screen to move through the screen to the next screen deck below, while the materials too large to fit through the mesh are separated out.

Gyratory equipment may include a system of eccentric weights. For example, a gyratory sifter may include a top weight and a bottom weight. The top weight may be coupled to a motor, which rotates the top weight in a plane that is close to the center of the mass of assembly. This may cause vibration and movement of the screens in the horizontal plane, which may cause material input to the screen surface to spread across the screen from the middle to the periphery or outer edges of the screen (i.e., the width of the screen). Such movement may move material too large to pass through the screen to be output and thus removed from the screen surface. A bottom eccentric weight may rotate below the center of mass and create a tilt on the screen surface. The tilt on the screen surface may cause vibration in a vertical and tangential plane. Such movement may induce particles smaller than the mesh size to pass through the screen surface at a more rapid pace and may encourage particles only slightly smaller than the mesh size to find the correct alignment for passing through the screen, thus increasing turnover. Horizontal or vertical motion may be amplified through spring assemblies.

However, the vibration of the screen may not cause the material to spread across the full width of the screen. As a result, parts of the screen may be unused, and the gyratory equipment may not be operating at full efficiency.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A housing inlet for a sifter is disclosed. The housing inlet includes a scalping screen sloped downward in a first direction. The housing inlet also includes a pan positioned at least partially below the scalping screen. The pan is sloped downward in a second direction that is different than the first direction.

A gyratory sifter is also disclosed. The gyratory sifter includes an upper deck. The upper deck includes an upper scalping screen sloped downward in a first direction. The upper deck also includes an upper pan positioned at least partially below the upper scalping screen. The upper pan is sloped downward in a second direction that is different than the first direction. The upper deck also includes a first upper screen positioned downstream from the upper pan. The openings in the upper pan are larger than openings in the first upper screen. The upper deck also includes a first lower screen positioned at least partially below the first upper screen. The openings in the first upper screen are larger than openings in the first lower screen. The second direction is toward the first upper screen, the second upper screen, or both. The gyratory sifter also includes a lower deck positioned at least partially below the upper deck. The lower deck includes a lower scalping screen sloped downward in the first direction. The lower deck also includes a lower pan positioned at least partially below the lower scalping screen. The lower pan is sloped downward in the second direction. The lower deck also includes a second upper screen positioned downstream from the lower pan. The lower deck also includes a second lower screen positioned at least partially below the second upper screen. The gyratory sifter also includes a motion generator configured to cause the upper deck and the lower deck to move.

A method for sifting a material is also disclosed. The method includes receiving the material via a housing inlet of a vibratory sifter. The method also includes causing at least a portion of the vibratory sifter to move. The method also includes distributing the material to a deck of the vibratory sifter. The method also includes sifting the material using a scalping screen of the deck. The scalping screen is sloped downward in a first direction. A first portion of the material that is too large to pass through the scalping screen flows down the scalping screen in the first direction to a scalping outlet. A second portion of the material passes through the scalping screen onto a pan of the deck. The pan is sloped downward in a second direction that is different from the first direction. The second direction is toward an upper screen of the deck. The method also includes sifting the second portion of the material using the upper screen.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Illustrative examples of the subject matter claimed below will now be disclosed. In the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

Spreader

Figure 1:
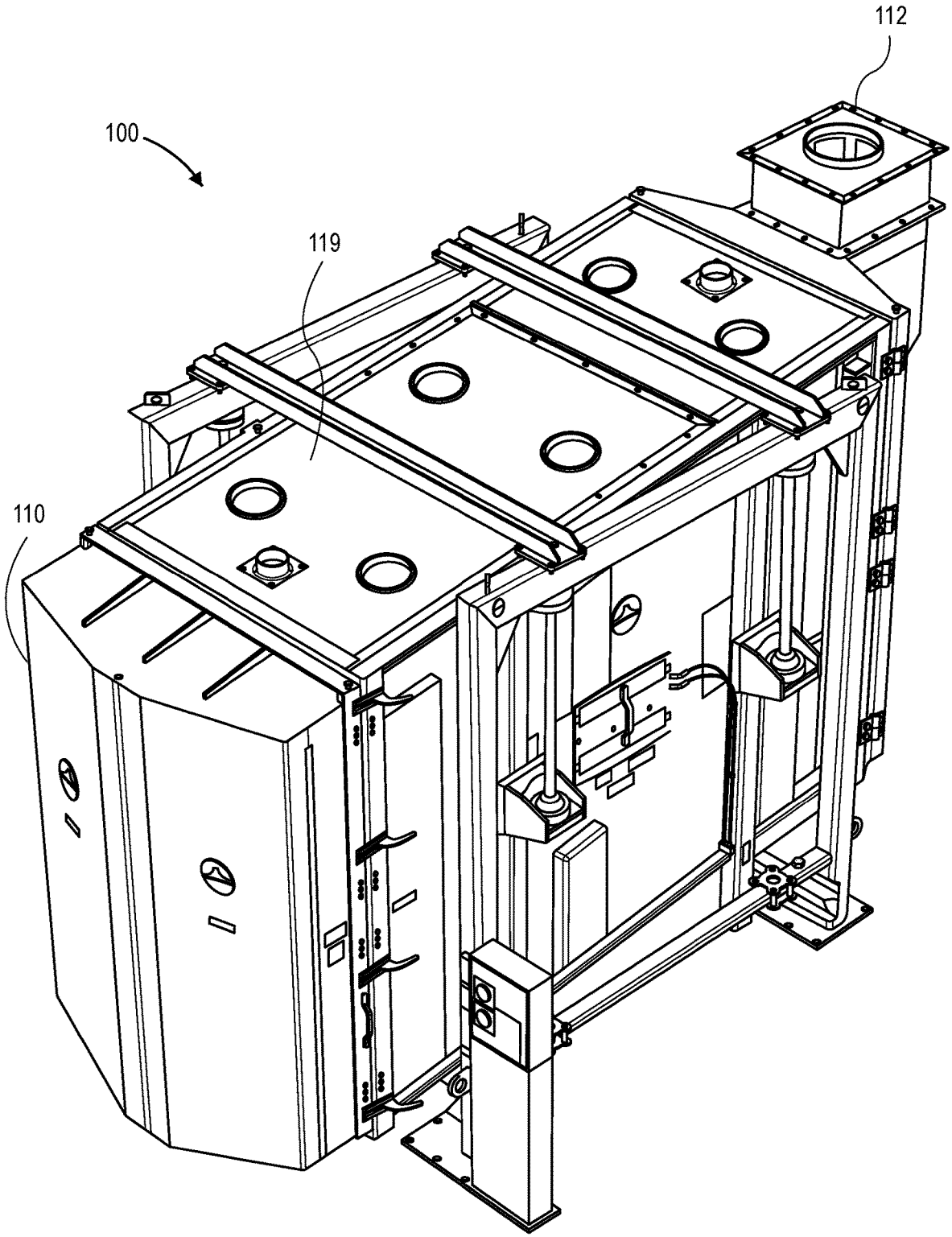
FIG. 1 illustrates a perspective view of an example of a gyratory sifter, according to an embodiment.
Figure 3:
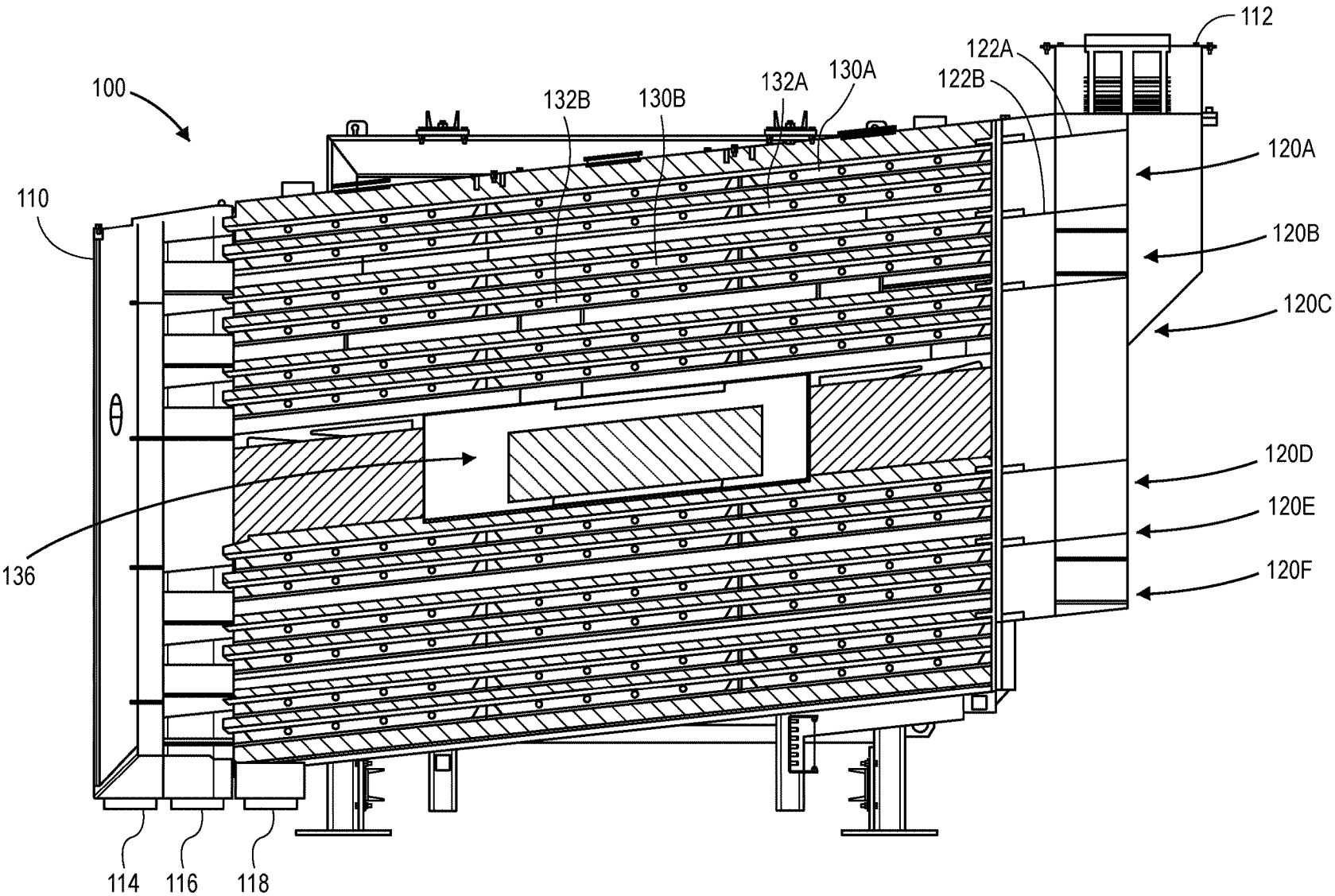
FIG. 3 illustrates a cross-sectional side view of the gyratory sifter, according to an embodiment.

FIG. 1 illustrates a perspective view of an example of a gyratory sifter 100, according to an embodiment. The gyratory sifter 100 may include a housing 110. The housing 110 may have one or more housing inlets (one is shown: 112) and one or more housing outlets (three are shown in FIG. 3: 114, 116, 118). As described in greater detail below, a material may be introduced into the housing 110 via the housing inlet 112. Illustrative materials may include, but are not limited to, frac sand, resin coated sand, ceramic proppant, activated carbon, fertilizer, limestone, petroleum coke, plastic pellets, polyvinyl chloride (PVC) powder, metallic powders, ceramic powders, roofing granules, salt, sugar, and grain. The material may be sifted within the housing 110 into one or more portions (e.g., three portions), as described below.

Figure 2:
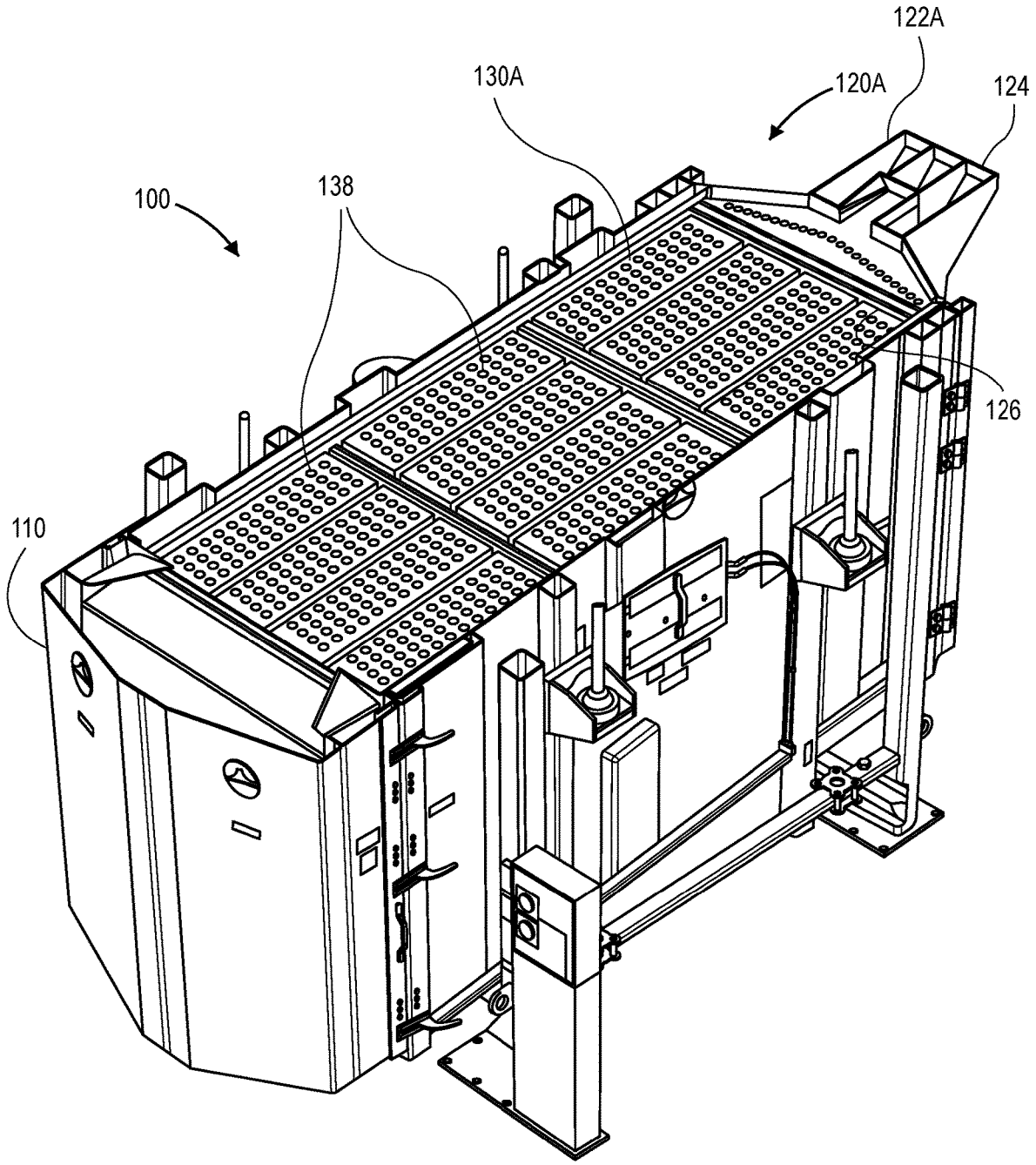
FIG. 2 illustrates a perspective view of the gyratory sifter with an upper panel removed, according to an embodiment.

FIG. 2 illustrates a perspective view of the gyratory sifter 100 with an upper panel 119 (shown in FIG. 1) removed, according to an embodiment. The gyratory sifter 100 may also include one or more decks (an upper deck is shown: 120A). The upper deck 120A may be positioned at least partially within the housing 110. The upper deck 120A may include an upper deck inlet 122A and one or more screens (an upper screen is shown: 130A). As described in greater detail below, at least a portion of the material may flow from the housing inlet 112 to the upper deck inlet 122A, and the material may then flow from the upper deck inlet 122A onto the upper screen 130A. Thus, the upper deck inlet 122A may have an upstream end 124 distal to the upper screen 130A, and a downstream end 126 proximate to the upper screen 130A.

FIG. 3 illustrates a cross-sectional side view of the gyratory sifter 100, according to an embodiment. As may be seen, the upper deck 120A may also include a lower screen 132A positioned at least partially below the upper screen 130A. In another embodiment, the upper deck 120A may include three or more screens arranged in a vertically-stacked manner. The screens 130A, 132A may each include a frame and a wire mesh. The wire meshes may include a plurality of openings. The wire mesh of the upper screen 130A may have relatively larger openings 138, and the wire mesh of the lower screen 132A may have relatively smaller openings. The upper screen 130A with the larger openings 138 may be referred to as having a larger mesh size, and the lower screen 132A with the smaller openings may be referred to as having a smaller mesh size.

The solid particles in the material that are too large to pass through the openings 138 in the upper screen 130A are directed to the first housing outlet 114. These solid particles are referred to as the overs. Thus, the first housing outlet 114 may also be referred to as the overs housing outlet. The solid particles in the material that pass through the openings 138 in the upper screen 130A but are too large to pass through the openings in the lower screen 132A are directed to the second housing outlet 116. These solid particles are referred to as the unders. Thus, the second housing outlet 116 may also be referred to as the unders housing outlet. The solid particles (and liquid if present) in the material that pass through the openings 138 in the upper screen 130A and the lower screen 132A are directed to the third housing outlet 118. These solid particles are referred to as the fines. Thus, the third housing outlet 118 may also be referred to as the fines housing outlet.

In addition, the gyratory sifter 100 may include a lower deck 120B. The lower deck 120B may be positioned at least partially within the housing 110. The lower deck 120B may be positioned at least partially below the upper deck 120A. More particularly, the lower deck 120B may be positioned at least partially below the lower screen 132A of the upper deck 120A. The lower deck 120B may include a lower deck inlet 122B and one or more screens (an upper screen 130B and a lower screen 132B are shown).

As described in greater detail below, a portion of the material may flow from the housing inlet 112 to the upper deck inlet 122A, and another portion of the material may flow from the housing inlet 112 to the lower deck inlet 122B. In one example, the material may be split into substantially equal portions using the splitter shown and described in U.S. Patent Publication No. 2019/0054502, which is incorporated by reference herein in its entirety to the extent that it is not inconsistent with the present description. The splitter may be positioned at least partially within the housing inlet 112. The splitter may include a bottom surface and a side wall coupled to the bottom surface. The side wall may extend perpendicularly away from the bottom surface. The bottom surface and the side wall may define a reservoir. The side wall may include one or more openings, and each opening may be of substantially equal area to distribute a substantially equal portion of the material to each deck.

The gyratory sifter 100 may also include a motion generator 136 positioned at least partially within the housing 110. The motion generator 136 may cause the decks 120A, 120B to move. More particularly, the motion generator 136 may cause the deck inlets 122A, 122B and the screens 130A, 132A, 130B, 132B to vibrate in one or more directions, which may facilitate the sifting (e.g., filtering) of the material. The upper and lower decks 120A, 120B may operate in parallel to sift (e.g., filter) the material into the overs, the unders, and the fines. The gyratory sifter 100 may also include one or more additional decks (four are shown: 120C-120F) in a vertically-stacked manner, which may be configured to operate in parallel with the decks 120A, 120B. For the sake of simplicity, the decks 120B-120F are not described in detail below.

Figure 4:
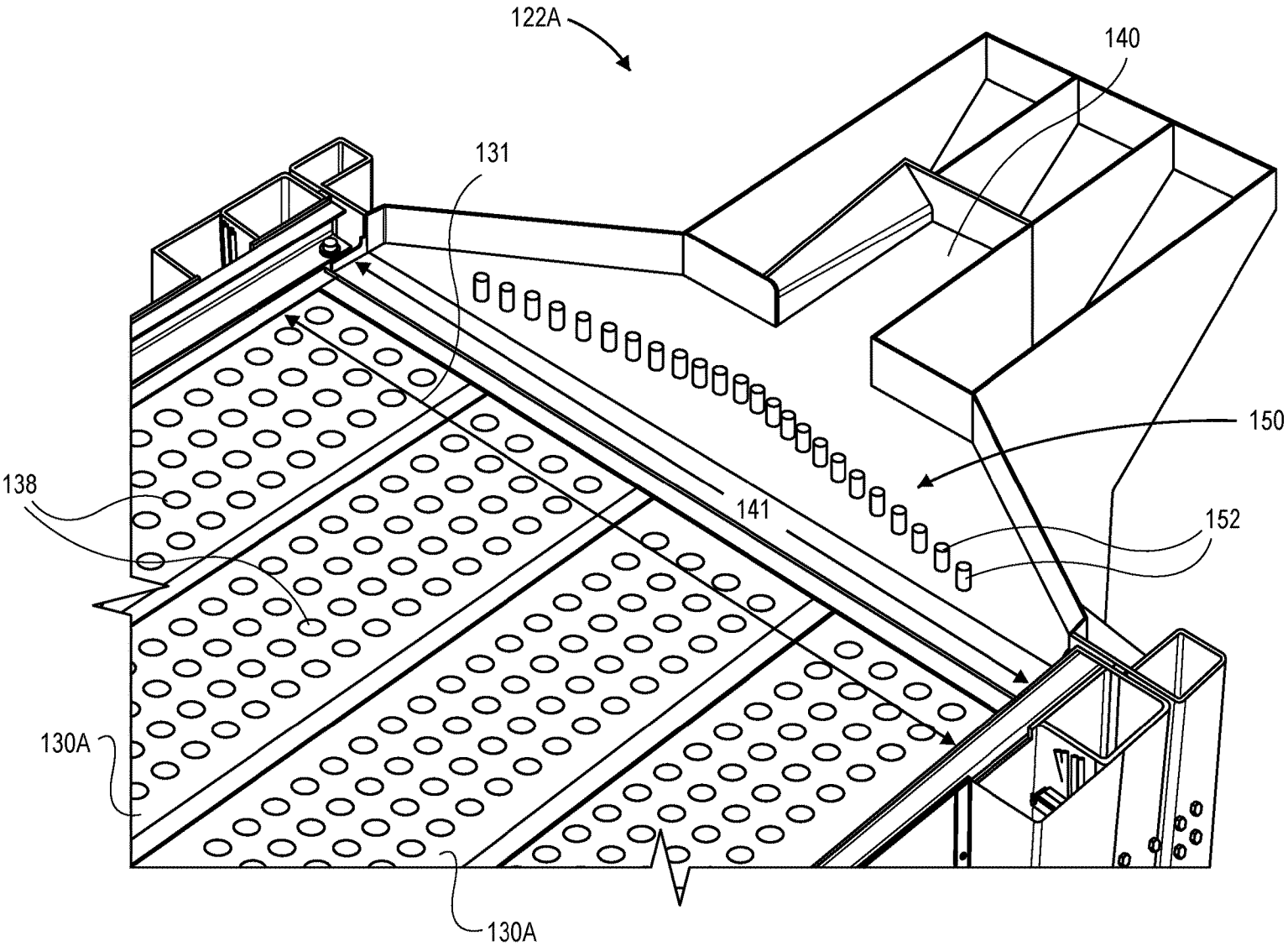
FIG. 4 illustrates an enlarged view of an upper deck inlet of the gyratory sifter, according to an embodiment.

FIG. 4 illustrates an enlarged perspective view of the upper deck inlet 122A, according to an embodiment. The upper deck inlet 122A may include a pan (also referred to as a bottom pan) 140 that is tilted or sloped, which may cause the material to flow down the pan 140 toward and/or onto the upper screen 130A.

The upper deck inlet 122A may also include a spreader 150 that is coupled to or integral with an upper surface of the pan 140. The spreader 150 may serve to spread the material substantially evenly across a width 141 of the pan 140 and/or a width 131 of the upper screen 130A. In one embodiment, "substantially evenly" refers to even volumetric portions+/−10% on each quadrant of the width 131 or 141. For example, the material may be spread substantially evenly when each quadrant receives from 15% to 35% of the material. In another embodiment, "substantially evenly" refers to even volumetric portions+/−5% on each quadrant of the width 131 or 141. For example, the material may be spread substantially evenly when each quadrant receives from 20% to 30% of the material.

In the embodiment shown, the spreader 150 may be or include a plurality of studs 152 that extend upwardly from the pan 140, and the material may flow between and/or over the studs 152. In another embodiment, the spreader 150 may be or include a single barrier with bores formed therethrough, and the material may flow through the bores and/or over the barrier. In yet another embodiment, the spreader 150 may be or include a single solid barrier (i.e., with no bores formed therethrough), and the material may flow over the barrier.

Figure 5:
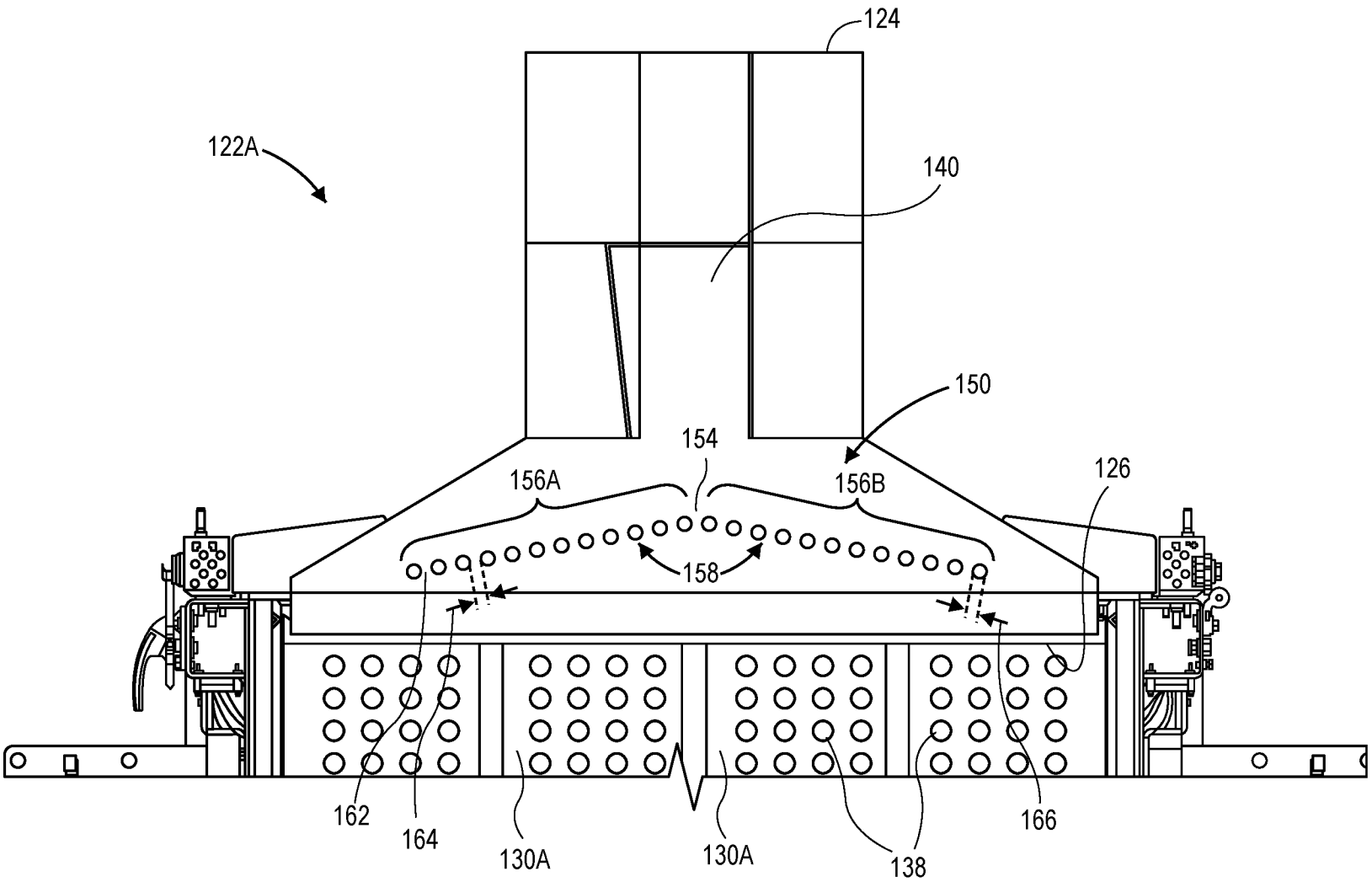
FIG. 5 illustrates a top view of the upper deck inlet, according to an embodiment.

FIG. 5 illustrates a top view of the upper deck inlet 122A, according to an embodiment. The spreader 150 may be substantially V-shaped and include a point 154 and two arms 156A, 156B. The point 154 may be positioned closer to the upstream end 124 of the upper deck inlet 122A than the downstream end 126 of the upper deck inlet 122A. Thus, distal ends of the arms 156A, 156B may be positioned closer to the downstream end 126 of the upper deck inlet 122A than the point 154. The arms 156A, 156B may be oriented in some examples at an angle 158 with respect to one another from about 90° to about 179°, about 135° to about 175°, or about 150° to about 170°.

As a result of this V-shape, the material may flow down the sloped pan 140 toward the spreader 150. The point 154 of the spreader 150 may be positioned in a middle portion along the width 141 of the pan 140 such that about half of the material contacts the spreader 150 on one side of the point 154, and about half of the material contacts the spreader 150 on the other side of the point 154. Thus, about half of the material may be directed along one arm 156A of the spreader 150, and about half of the material may be directed along the other arm 156B of the spreader 150.

As shown, the spreader 150 may not extend across the full width 141 of the pan 140. Rather, the spreader 150 (e.g., the arms 156A, 156B) may extend across in some examples from about 50% to about 95%, about 60% to about 90%, or about 70% to about 85% of the width 141 of the pan. In another embodiment, the spreader 150 (e.g., the arms 156A, 156B) may extend across the full width 141 of the pan 140.

A gap 162 may be defined between each two adjacent studs 152. In one embodiment, the width 164 of each gap 162 may remain substantially constant proceeding from the point 154 to the distal ends of the arms 156A, 156B. However, in the embodiment shown, the widths 164 of the gaps 162 may increase proceeding from the point 154 to the distal ends of the arms 156A, 156B. In other words, the width 164 of a gap 162 between two adjacent studs 152 that are proximate (e.g., closer) to the point 154 may be less than the width 164 of a gap 162 between two adjacent studs 152 that are proximate (e.g., closer) to the distal ends of the arms 156A and/or 156B. This may facilitate spreading the material evenly across the width 141 of the pan 140.

A width 166 of the studs 152 may in some examples range from about 1 mm to about 2 cm, about 2 mm to about 1.5 cm, or about 3 mm to about 1 cm. The width 166 of the studs 152 may be measured in a direction that is parallel to the width 141 of the pan 140, or it may be measured in a direction that is parallel with one or both arms 156A, 156B of the spreader 150. A ratio of the width 166 of the one of the studs 152 to the width 164 of one of the gaps 162 may in some examples be from about 1:1 to about 1:5, about 1:1 to about 1:4, about 1:1 to about 1:3, or about 1:1 to about 1:2. As will be appreciated, in embodiments where the widths 164 of the gaps 162 vary proceeding from the point 154 to the distal ends of the arms 156A, 156B, the ratio may also vary such that the ratio may be smaller (e.g., about 1:1) proximate to the point 154 and larger (e.g., about 1:5) proximate to the distal ends of the arms 156A, 156B.

The studs 152 may have a cross-sectional shape that is rounded (e.g., substantially circular). Having a rounded cross-sectional shape may result in a larger surface area on the upstream side of the studs 152 that is contacted by the material, which may reduce the rate at which the studs 152 are worn down over time due to contact with the flowing material, which can be abrasive. However, in other embodiments, the cross-sectional shape may be ovular, elliptical, square, rectangular, or the like.

Figure 6:
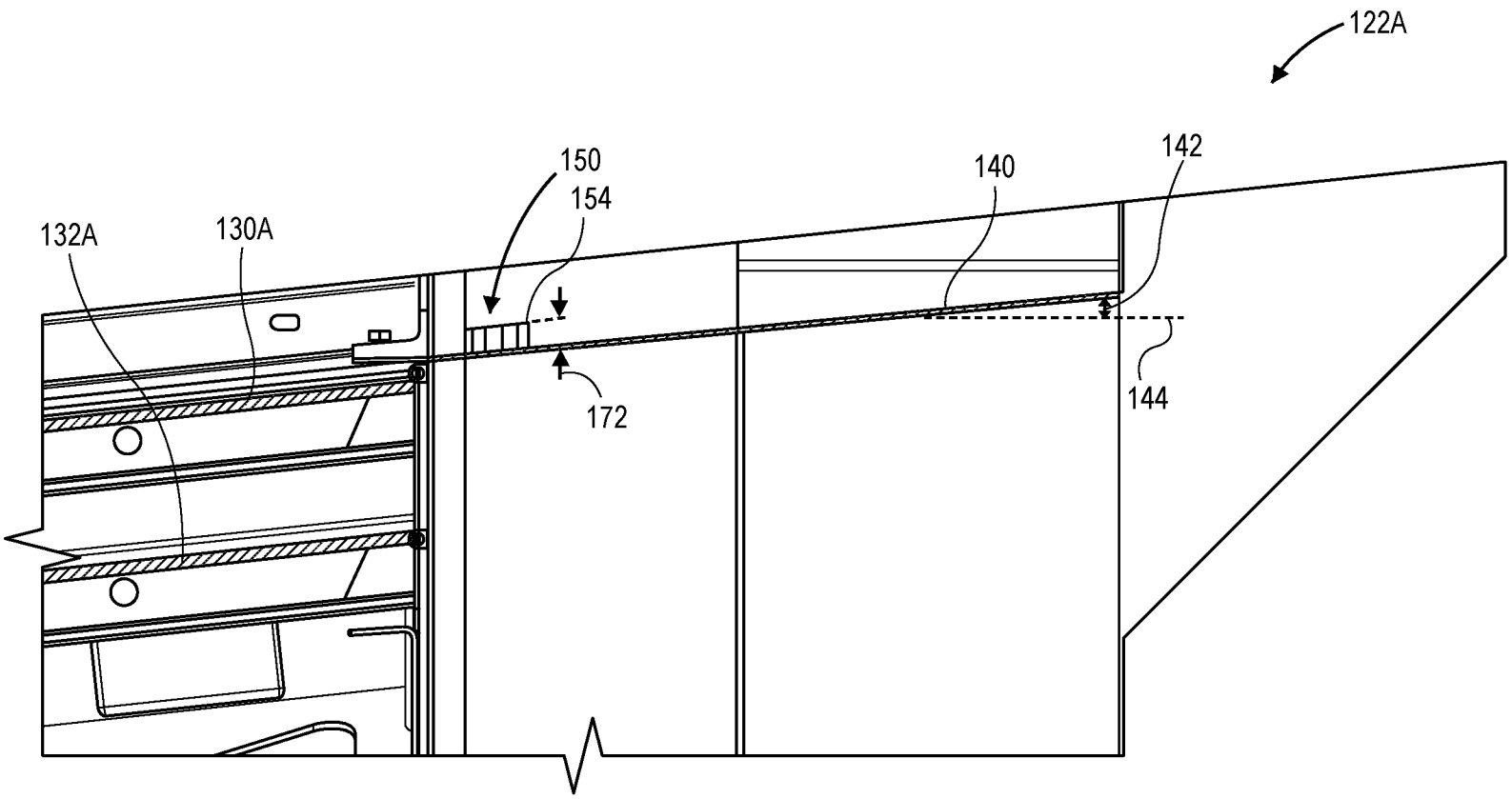
FIG. 6 illustrates a cross-sectional side view of the upper deck inlet, according to an embodiment.

FIG. 6 illustrates a cross-sectional side view of the upper deck inlet 122A, according to an embodiment. As mentioned above, the pan 140 may in some examples be tilted or sloped at an angle 142 from about 2° to about 20° or about 4° to about 10° with respect to a horizontal plane 144. This tilt may cause the material to flow down the pan 140 toward the upper screen 130A and/or the spreader 150.

In one example, a central longitudinal axis through one or more of the studs 152 may be substantially perpendicular to the pan 140. Thus, the central longitudinal axis may in some examples be oriented at an angle from about 2° to about 10° or about 4° to about 8° with respect to a vertical axis. In another example, the central longitudinal axis may be substantially parallel to the vertical axis.

A height 172 of the spreader 150 (e.g., of the studs 152) may be substantially constant proceeding from the point 154 to the distal ends of the arms 156A, 156B. In another embodiment, the height 172 may decrease proceeding from the point 154 to the distal ends of the arms 156A, 156B. The height 172 may be selected based at least partially upon the width 141 of the pan 140, the width 166 of the studs 152, the widths 164 of the gaps 162, the volumetric flow rate of the material flowing into and/or through the upper deck inlet 122A, or a combination thereof. For example, the height 172 of the spreader 170 (e.g., of the studs 152) may in some examples range from about 5 mm to about 3 cm, about 1 cm to about 2.5 cm, or about 1.5 cm to about 2 cm.

The height 172 may be selected such that the material flows through the gaps 162, but not over the studs 152, when the flow rate of the material is below a predetermined rate. The height 172 may also be selected such that the material flows through the gaps 162 and over the studs 152 when the flow rate of the material is above the predetermined rate (e.g., a surge of material). This may help to prevent a blockage in the housing inlet 112.

Figure 7:
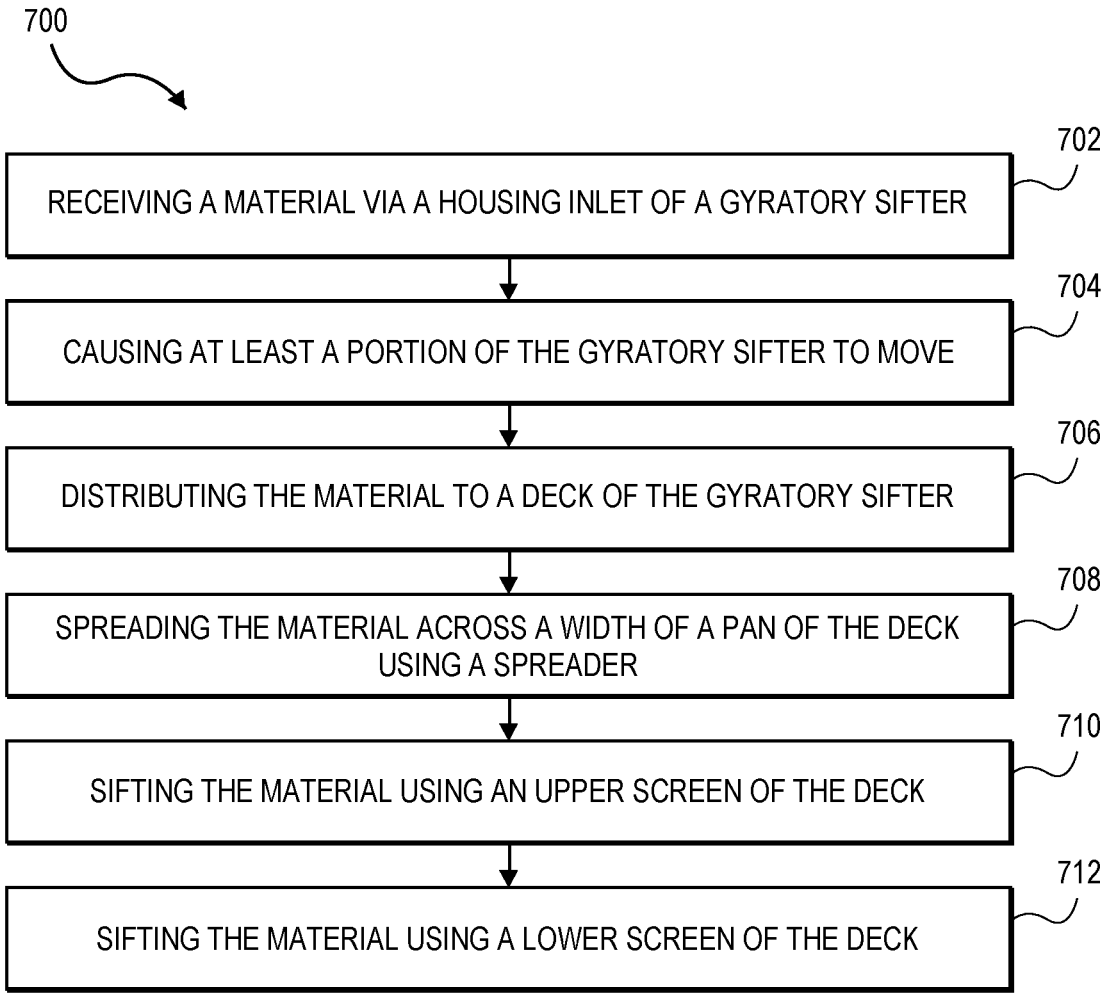
FIG. 7 illustrates a flowchart of a method for sifting a material, according to an embodiment.

FIG. 7 illustrates a flowchart of a method 700 for sifting (e.g., filtering) the material, according to an embodiment. The method 700 is described with reference to the gyratory sifter 100 described above; however, one or more portions of the method 700 may also or instead be performed using other gyratory sifters. An illustrative order of the method 700 is provided below; however, one or more portions of the method 700 may be performed in a different order or omitted.

The method 700 may include receiving the material via the housing inlet 112, as at 702. The method 700 may also include causing at least a portion of the gyratory sifter 100 to move, as at 704. The movement may be or include vibratory motion generated by the motion generator 136. The vibratory motion may be imparted to the housing inlet 112, the deck inlets 122A, 122B, the screens 130A, 132A, 130B, 132B, or a combination thereof.

The method 700 may also include distributing the material to the upper deck 120A, as at 706. The material may also be distributed to the lower deck 120B. The vibratory motion may facilitate the distribution of the material to the decks 120A-120F. The material may be distributed in substantially equal amounts to each deck 120A-120F using the splitter.

The method 700 may also include spreading the material across the width 141 of the pan 140 using the spreader 150, as at 708. The vibratory motion may facilitate the spreading of the material across the width 141 of the pan 140. The material may flow down the pan 140 toward the spreader 150. As mentioned above, the point 154 of the spreader 150 may be located in a middle portion of the width 141 of the pan 140 such that about half of the material contacts the spreader 150 on one side of the point 154, and the other half of the material contacts the spreader 150 on the other side of the point 154.

A portion of the material may flow through the gaps 162 between the inner studs 152 (e.g., the stud 152 that is located at the point 154 and the two studs 152 on either side thereof). Due to the slope of the pan 140 and/or the V-shape of the spreader 150, a remainder of the material may flow outward along the arms 156A, 156B of the spreader 150. As will be appreciated, additional portions of the material may flow through the gaps 162 between each pair of adjacent studs 152 proceeding outwardly along the arms 156A, 156B of the spreader 150. In this manner, the material may be spread (e.g., divided) substantially evenly along the width 141 of the pan 140 and/or the width 131 of the upper screen 130A.

In an example, there may be eleven studs 152, with one at the point 154, and five making up each arm 156A, 156B. Thus, in this example, there may be ten gaps 162 between studs 152 (e.g., five gaps 162 on each arm 156A, 156B). A substantially equal portion of the material (e.g., 10%) may flow through each of the ten gaps 162. This may be at least partially due to a volumetric flow rate of the material into/through the upper deck inlet 122A, the width 141 of the pan 140, angle 142 at which the pan 140 is oriented, the shape of the spreader 150 (e.g., V-shaped), the shape of the studs 152 (e.g., rounded), the width 166 of the studs 152, the widths 164 of the gaps 162, the height 172 of the studs 152, or a combination thereof.

Instead of, or in addition to, causing a substantially equal portion of the material to flow through each of the gaps 162, the spreader 150 may cause different amounts of material to flow through each of the gaps 162. However, the spreader 150 may cause the material to be spread substantially equally across the width 141 of the pan 140 and/or the width 131 of the upper screen 130A. More particularly, the spreader 150 may result in the material being spread substantially equally across the width 131 of the upper screen 130A starting at/proximate to an upstream end 134 of the upper screen 130A (see FIG. 5). This may increase the surface area of the upper screen 130A and/or the lower screen 132A that is used to sift (e.g., filter) the material. In addition, by spreading the material substantially evenly across the width 131 of the upper screen 130A, the upper screen 130A may be able to sift (e.g., filter) the material more efficiently and at a faster rate.

The method 700 may also include sifting the material using the upper screen 130A, as at 710. The vibratory motion may facilitate the sifting of the material using the upper screen 130A. The solid particles that are larger than the openings 138 in the upper screen 130A, and thus cannot pass through the upper screen 130A (i.e., the overs), may be directed to the first housing outlet 114. The solid particles that pass through the upper screen 130A land on the lower screen 132A.

The method 700 may also include sifting the material using the lower screen 132A, as at 712. The vibratory motion may facilitate the sifting of the material using the lower screen 130B. The solid particles that are larger than the openings in the lower screen 132A, and thus cannot pass through the lower screen 132A (i.e., the unders), may be directed to the second housing outlet 116. The solid particles that pass through the openings in the lower screen 132A (i.e., the fines) may be directed to the third housing outlet 118.

The decks 120A-120F may operate in series or parallel. When the decks 120A-120F operate in parallel, the portions of the method 708-712 may occur substantially simultaneously for each deck 120A-120F.

Scalping Screen

Figure 8:
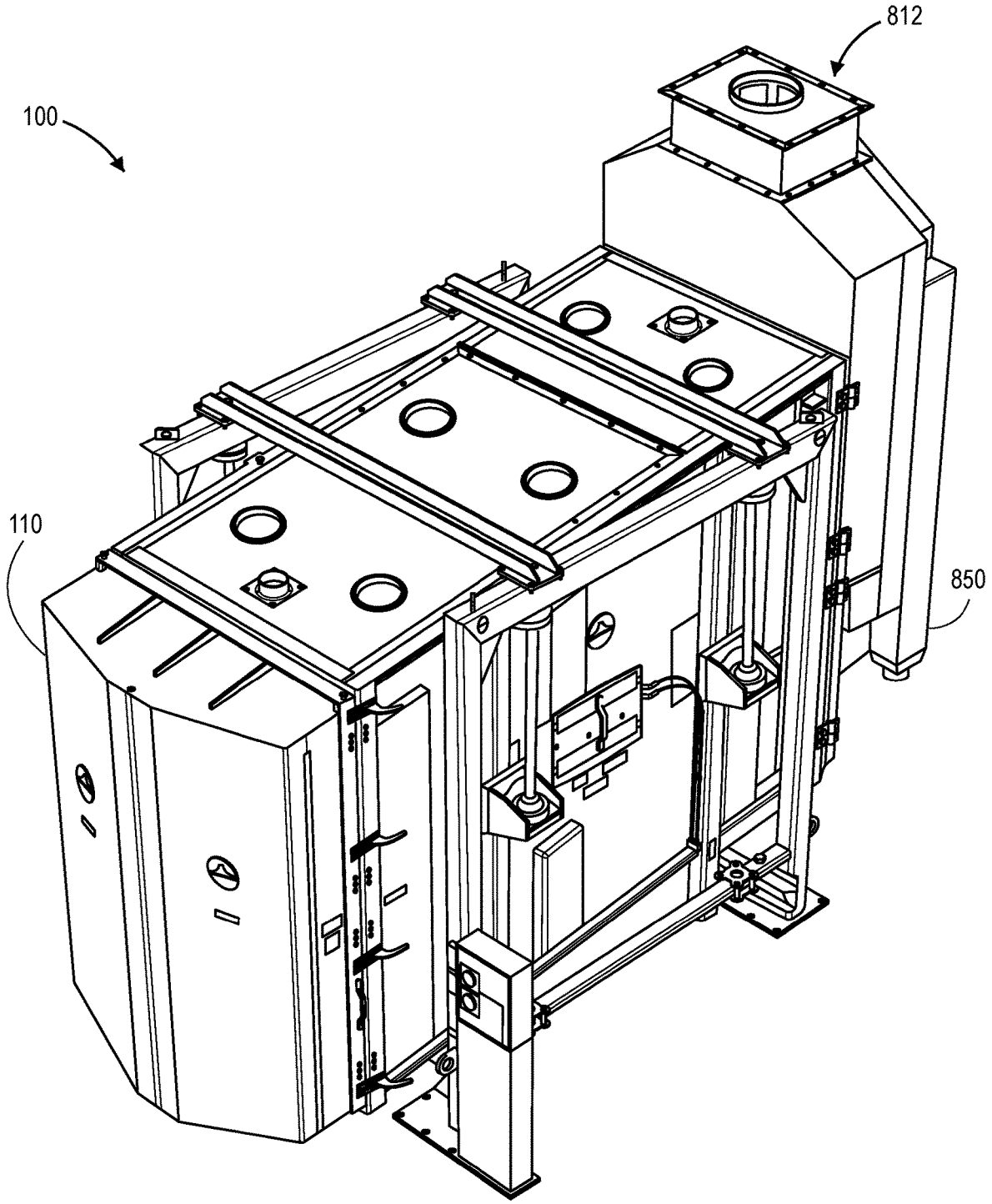
FIG. 8 illustrates a perspective view of the gyratory sifter having a different housing inlet, according to an embodiment.

FIG. 8 illustrates another perspective view of the gyratory sifter 100, according to an embodiment. The gyratory sifter 100 may be substantially the same as described above; however, the gyratory sifter 100 in FIG. 8 has a different housing inlet 812 than the housing inlet 112 described above. The housing inlet 812 may also be referred to as an inlet door.

Figure 9:
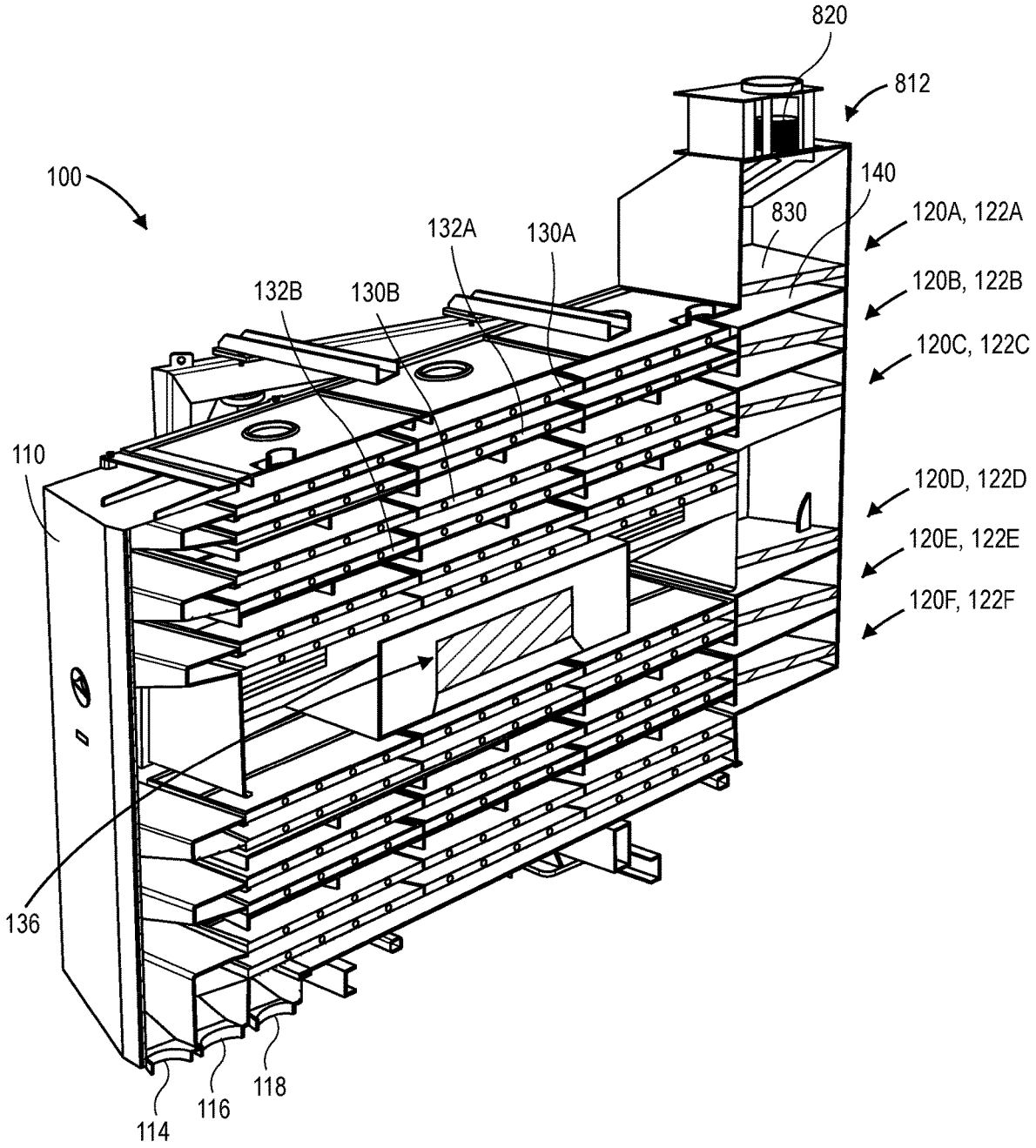
FIG. 9 illustrates a cross-sectional perspective view of the gyratory sifter of FIG. 8, according to an embodiment.

FIG. 9 illustrates a cross-sectional perspective view of the gyratory sifter 100 having the housing inlet 812, according to an embodiment. As mentioned above, the housing inlet 812 may include the splitter 820, which may split the incoming material into substantially equal portions and distribute the substantially equal portions to the deck inlets 122A-122F. The deck inlets 122A-122F may be positioned at least partially within the housing inlet 812. For the sake of simplicity and clarity, the upper deck 120A, which includes the upper deck inlet 122A, is described below; however, it will be appreciated that the other decks 120B-120F may be similar to the upper deck 120A and may operate in parallel with the upper deck 120A.

As mentioned above, the upper deck inlet 122A may include the pan 140 and/or the spreader 150 that is/are positioned upstream from the screens 130A, 132A. In addition, the upper deck inlet 122A may also include a scalping screen 830. The scalping screen 830 may pre-screen the incoming material before the incoming material reaches the pan 140, the spreader 150, and/or the screens 130A, 132A of the upper deck 120A. The scalping screen 830 may be positioned at least partially above the pan 140. Thus, the scalping screen 830 may be positioned upstream from the pan 140.

The scalping screen 830 may include a frame and a wire mesh. The wire mesh may include a plurality of openings 838. The openings 838 in the wire mesh of the scalping screen 830 may be larger than the openings 138 in the wire mesh of the upper screen 130A, and, as mentioned above, the openings 138 in the wire mesh of the upper screen 130A may be larger than the openings in the wire mesh of the lower screen 132A.

Figure 10:
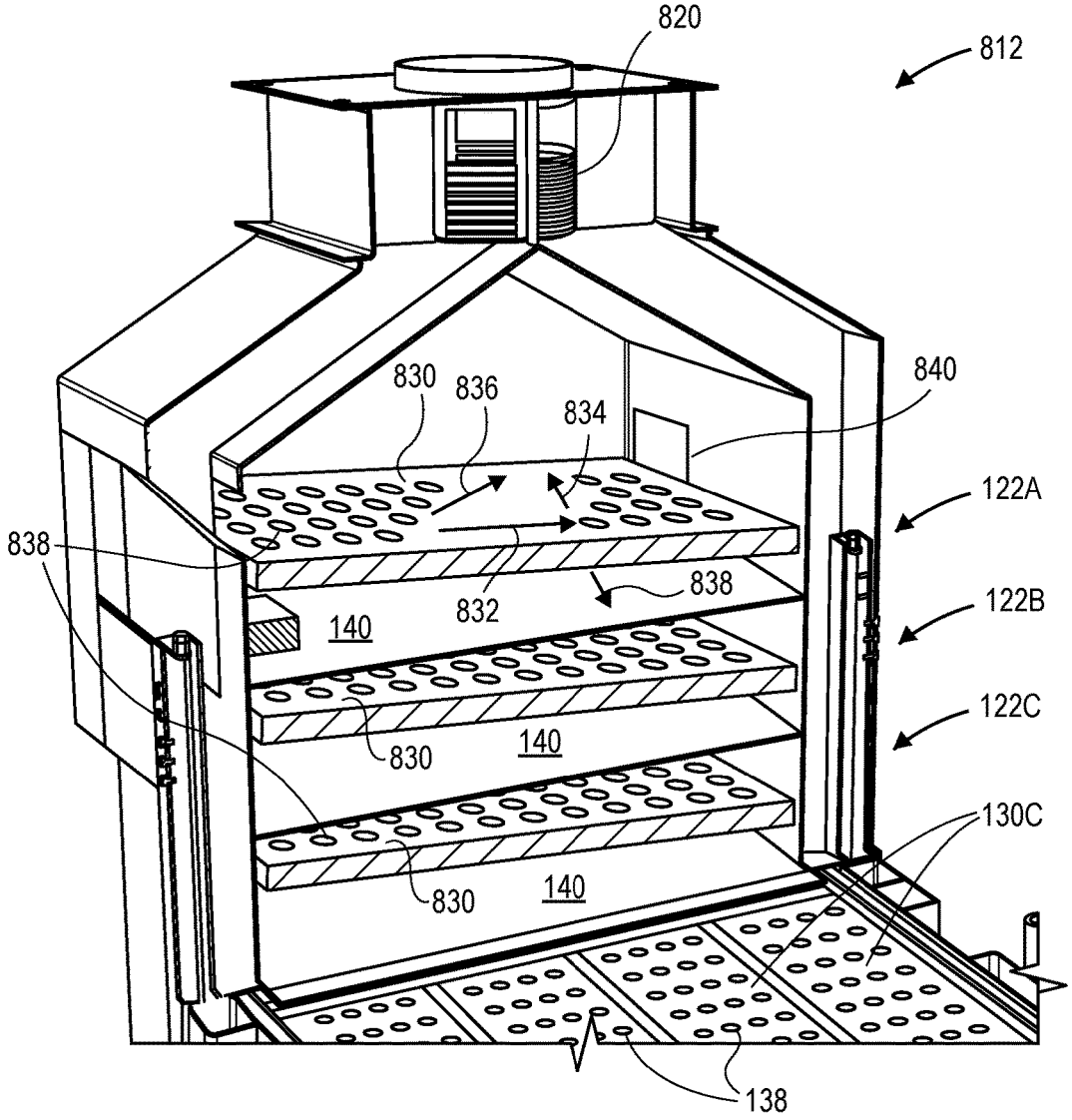
FIG. 10 illustrates a cross-sectional perspective view of a portion of the housing inlet of FIG. 8, according to an embodiment.

FIG. 10 illustrates a cross-sectional perspective view of a portion of the housing inlet 812, according to an embodiment. The scalping screen 830 may be sloped downward proceeding in a direction 832. For example, the scalping screen 830 may be sloped downward in the direction 832 at an angle from about 0.5° to about 6° or about 1° to about 3° with respect to a horizontal plane.

In at least one embodiment, the scalping screen 830 may also or instead be sloped downward proceeding in a direction 834. For example, the scalping screen 830 may be sloped downward in the direction 834 at an angle from about 0.5° to about 6° or about 1° to about 3° with respect to a horizontal plane. As a result, the scalping screen 830 may be sloped at in a combined direction 836. The aforementioned angle that the scalping screen 830 is sloped downward (e.g., about 0.5° to about 6° or about 1° to about 3°) may be less than the angle at which the pan 140 is sloped downward (e.g., about 2° to about 20° or about 4° to about 10°) and/or less than the angle at which the screens 130A, 130B are sloped downward (e.g., about 2° to about 20° or about 4° to about 10°).

The direction(s) 832, 834, and/or 836 that the scalping screen 830 is sloped downward may be different from a direction 838 that the pan 140 is sloped downward. More particularly, the direction 832 may be substantially perpendicular to the direction 838 that the pan 140 is sloped downward. The direction 834 may be opposite to the direction 838 that the pan 140 is sloped downward. For example, the scalping screen 830 may be sloped downward in the direction 834, which is away from the screens 130A, 132A, and the pan 140 may be sloped downward in the direction 838, which is toward the screens 130A, 132A. The direction 836 may, in some examples, be oriented at an angle from about 95° to about 175° or about 110° to about 160° with respect to the direction 838. As will be appreciated, the screens 130A, 132A are not shown in FIG. 10 because they would obstruct part of the view; however, the upper screen 130C of the third deck 120C is shown in FIG. 10, and the screens 130A, 132A would be positioned above the upper screen 130C if shown in FIG. 10.

Due to the slope of the scalping screen 830, the solid particles (and liquid if present) in the incoming material may flow down the scalping screen 830 in the direction 832, 834, or 836. The solid particles in the incoming material that are larger than the openings 838 in the scalping screen 830 may not pass through the scalping screen 830. Rather the solid particles in the incoming material that are larger than the openings 838 in the scalping screen 830 may flow down the scalping screen 830 in the direction 832, 834, or 836 and be directed into and/or through a door 840 in the housing inlet 812 to a scalping outlet 850, which is shown in FIG. 8.

The solid particles in the incoming material that are smaller than the openings 838 in the scalping screen 830 may pass through the openings 838 in the scalping screen 830 onto the pan 140, and may then proceed as described above with reference to FIGS. 1-7. For example, the solid particles may flow down the pan 140, through, around, and/or over the spreader 150, onto the upper screen 130A. The solid particles that are too large to pass through the openings 138 in the upper screen 130A (i.e., the overs) are directed to the first housing outlet 114. The solid particles that pass through the openings 138 in the upper screen 130A but are too large to pass through the openings in the lower screen 132A (i.e., the unders) are directed to the second housing outlet 116. The solid particles (and liquid if present) that pass through the openings 138 in the upper screen 130A and the lower screen 132A (i.e., the fines) are directed to the third housing outlet 118.

Figure 11:
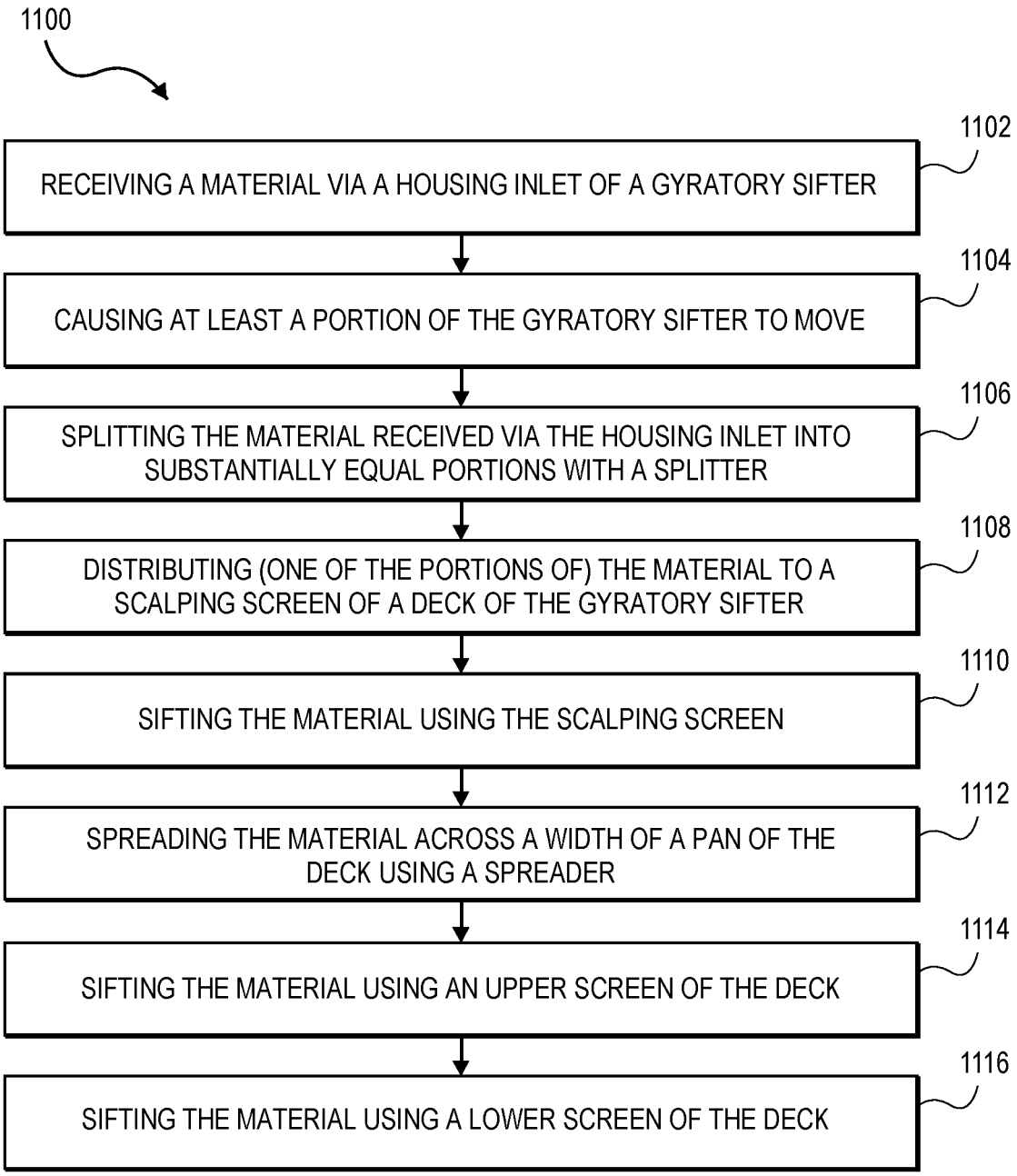
FIG. 11 illustrates a flowchart of another method for sifting the material, according to an embodiment.

FIG. 11 illustrates a flowchart of a method 1100 for sifting (e.g., filtering) the material, according to an embodiment. The method 1100 is described with reference to the gyratory sifter 100 with the housing inlet 812 (in FIGS. 8-10); however, one or more portions of the method 1100 may also or instead be performed using other gyratory sifters. An illustrative order of the method 1100 is provided below; however, one or more portions of the method 100 may be performed in a different order or omitted.

The method 1100 may include receiving the material via the housing inlet 812, as at 1102. The method 1100 may also include causing at least a portion of the gyratory sifter 100 to move, as at 1104. The movement may be or include vibratory motion generated by the motion generator 136. The vibratory motion may be imparted to the housing inlet 812, the splitter 820, the deck inlets 122A, 122B, the scalping screen(s) 830, the screens 130A, 130B, 132A, 132B, or a combination thereof.

The method 1100 may also include splitting the material received via the housing inlet 812 with the splitter 820, as at 1106. The vibratory motion may facilitate the splitting of the material. In the example shown, there are six decks 120A-120F, so the material may be split into six substantially equal portions (e.g., about 16.7% each). The substantially equal portions may differ from one another by less than 5% (e.g., from about 11.7% to about 21.7%).

The method 1100 may also include distributing (one of the portions of) the material to scalping screen 830 of the upper deck 120A, as at 1108. The vibratory motion may facilitate the distribution of the material from the splitter 820 to the scalping screen 830. The portions of the material may also be distributed to the scalping screens of the other decks 120B-120F.

The method 1100 may also include sifting the material using the scalping screen 830, as at 1110. The vibratory motion may facilitate the sifting of the material using the scalping screen 830. As mentioned above, the solid particles in the material that are larger than the openings 838 in the scalping screen 830 may flow down the scalping screen 830 and through the door 840 to the scalping outlet 850. The solid particles in the material that are smaller than the openings 838 in the scalping screen 830 may pass through the openings 838 in the scalping screen 830 and land on the pan 140.

The method 1100 may also include spreading the material across the width 141 of the pan 140 using the spreader 150, as at 1112. The vibratory motion may facilitate the spreading of the material across the width 141 of the pan 140. This may be similar to 708 above, and for the sake of brevity, the details are not repeated here.

The method 1100 may also include sifting the material using the upper screen 130A, as at 1114. The vibratory motion may facilitate the sifting of the material using the upper screen 130A. The solid particles that are larger than the openings 138 in the upper screen 130A, and thus cannot pass through the upper screen 130A (i.e., the overs), may be directed to the first housing outlet 114. The solid particles that pass through the upper screen 130A land on the lower screen 132A.

The method 1100 may also include sifting the material using the lower screen 130B, as at 1116. The vibratory motion may facilitate the sifting of the material using the lower screen 130B. The solid particles that are larger than the openings in the lower screen 132A, and thus cannot pass through the lower screen 132A (i.e., the unders), may be directed to the second housing outlet 116. The solid particles that pass through the openings in the lower screen 132A (i.e., the fines) may be directed to the third housing outlet 118.

The decks 120A-120F may operate in series or parallel. When the decks 120A-120F operate in parallel, the portions of the method 1108-1116 may occur substantially simultaneously for each deck 120A-120F.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

What is claimed is:

1. A housing inlet for a sifter, comprising: a scalping screen sloped downward in a first direction; a pan positioned at least partially below the scalping screen, wherein the pan is sloped downward in a second direction that is different than the first direction; a scalping outlet; and a splitter configured to receive a material and split the material into substantially equal portions to distribute one of the portion to the scalping screen.

2. The housing inlet of claim 1, wherein the first direction is substantially perpendicular to the second direction.

3. The housing inlet of claim 1, wherein the first direction is opposite to the second direction.

4. The housing inlet of claim 1, wherein the first direction is oriented at an angle from about 95° to about 175° with respect to the second direction.

5. The housing inlet of claim 1, wherein the scalping screen is sloped downward at a first angle with respect to a horizontal plane, wherein the pan is sloped downward at a second angle with respect to the horizontal plane, and wherein the first angle that is less than the second angle.

6. The housing inlet of claim 5, wherein the first angle is from about 1° to about 3°, and wherein the second angle is from about 4° to about 10°.

7. The housing inlet of claim 1, wherein the scalping screen is configured to receive the one of the portions of the material, wherein a first amount of the material that is too large to pass through the scalping screen flows down the scalping screen in the first direction to the scalping outlet, and wherein a second amount of the material passes through the scalping screen onto the pan.

8. The housing inlet of claim 1, further comprising:

a second scalping screen positioned at least partially below the pan, wherein the scalping screen and the second scalping screen are configured to operate in parallel; and a second pan positioned at least partially below the second scalping screen, wherein the pan and the second pan are configured to operate in parallel.

9. A gyratory sifter, comprising:

an upper deck comprising:

an upper scalping screen sloped downward in a first direction;

an upper pan positioned at least partially below the upper scalping screen, wherein the upper pan is sloped downward in a second direction that is different than the first direction;

a first upper screen positioned downstream from the upper pan, wherein openings in the upper pan are larger than openings in the first upper screen;

a scalping outlet, wherein the upper scalping screen is configured to receive a material, wherein a first portion of the material that is too large to pass through the upper scalping screen flows down the upper scalping screen in the first direction to the scalping outlet, and wherein a second portion of the material passes through the upper scalping screen onto the upper pan, wherein the upper pan comprises a spreader that is configured to spread the second portion of the material substantially evenly across a width of the first upper screen; and a first lower screen positioned at least partially below the first upper screen, wherein the openings in the first upper screen are larger than openings in the first lower screen;

a lower deck positioned at least partially below the upper deck, wherein the lower deck comprises:

a lower scalping screen sloped downward in the first direction;

a lower pan positioned at least partially below the lower scalping screen, wherein the lower pan is sloped downward in the second direction;

a second upper screen positioned downstream from the lower pan; and a second lower screen positioned at least partially below the second upper screen; and a motion generator configured to cause the upper deck and the lower deck to move.

10. The gyratory sifter of claim 9, wherein the first direction is substantially perpendicular to the second direction, opposite to the second direction, or a combination thereof.

11. The gyratory sifter of claim 10, wherein the upper scalping screen is sloped downward at a first angle from about 1° to about 3° with respect to a horizontal plane, and wherein the upper pan is sloped downward at a second angle from about 4° to about 10° with respect to the horizontal plane.

12. A method for sifting a material, comprising:

receiving the material via a housing inlet of a vibratory sifter;

causing at least a portion of the vibratory sifter to move;

splitting the material received via the housing inlet into substantially equal portions using a splitter;

distributing one of the portions of the material to a deck of the vibratory sifter;

sifting the material using a scalping screen of the deck, wherein the scalping screen is sloped downward in a first direction, wherein a first portion of the material that is too large to pass through the scalping screen flows down the scalping screen in the first direction to a scalping outlet, wherein a second portion of the material passes through the scalping screen onto a pan of the deck, wherein the pan is sloped downward in a second direction that is different from the first direction, and wherein the second direction is toward an upper screen of the deck; and sifting the second portion of the material using the upper screen.

13. The method of claim 12, wherein the first direction is substantially perpendicular to the second direction, opposite to the second direction, or a combination thereof.

14. The method of claim 13, wherein the scalping screen is sloped downward at a first angle from about 1° to about 3° with respect to a horizontal plane, and wherein the pan is sloped downward at a second angle from about 4° to about 10° with respect to the horizontal plane.

15. The method of claim 14, further comprising spreading the second portion of the material substantially evenly across a width of the upper screen using a spreader that is coupled to or integral with the pan.

16. The housing inlet of claim 7, wherein the housing inlet defines a door, and wherein the first amount of the material flows from the scalping screen, through the door, and into the scalping outlet.

* * * * *